US005195744A

United States Patent [19]

Kapp et al.

[11] Patent Number: 5,195,744

[45] Date of Patent: Mar. 23, 1993

[54] BASEBALL BATTING PRACTICE APPARATUS WITH CONTROL MEANS

[75] Inventors: Neil S. Kapp; Roger J. Gallant, both of London; Mark W. Davis, Iona Station, all of Canada

[73] Assignee: Video Baseball, Inc., London, Canada

[21] Appl. No.: 791,207

[22] Filed: Nov. 13, 1991

[51] Int. Cl.[5] ..... A63B 69/40

[52] U.S. Cl. ..... 273/26 D

[58] Field of Search ..... 273/25, 26 R, 26 D, 273/29 R, 29 A, 85 G, DIG. 28

[56] References Cited

U.S. PATENT DOCUMENTS

| | | | |
|---|---|---|---|
| 1,213,577 | 1/1917 | Boardman | 273/26 D X |
| 3,203,696 | 8/1965 | Sawyer | 273/29 R |
| 3,306,613 | 2/1967 | Mainers | 273/26 D |
| 3,531,116 | 9/1970 | Trzesniewski | 273/26 D |
| 3,580,388 | 5/1971 | Resener | 198/198 |
| 3,724,437 | 4/1973 | Halstead | 273/26 D X |
| 4,841,945 | 6/1989 | Braden | 273/29 A X |
| 4,915,384 | 4/1990 | Bear | 273/26 R |
| 5,066,010 | 11/1991 | Pingston | 273/26 D |
| 5,097,985 | 3/1992 | Jones | 273/26 D X |
| 5,125,653 | 6/1992 | Kovacs et al. | 273/26 D X |

FOREIGN PATENT DOCUMENTS 8500530 7/1985 World Int. Prop. O. .

*Primary Examiner*—William H. Grieb

*Attorney, Agent, or Firm*—Hurt, Richardson, Garner, Todd & Cadenhead

[57] ABSTRACT

A baseball batting practice apparatus includes a display screen having a passage therethrough and a video projector for projecting a moving image of a baseball pitcher on the screen adjacent the passageway. An electronic control unit detects that the baseball pitcher of the moving image is about to release a pitch in the moving image and creates a signal. In response to the signal, a baseball retaining and releasing mechanism adjacent a conduit is controlled for allowing a baseball to be released and to travel, urged by gravity, along the conduit toward a baseball pitching machine which is positioned to one side of the display screen. The electronic control unit is adapted to synchronize the propelling of the baseball through the passageway with the moving image such that the propelled baseball appears to be thrown by the moving image of the baseball pitcher. The electronic control unit is associated with and controlled by a personal computer.

10 Claims, 7 Drawing Sheets

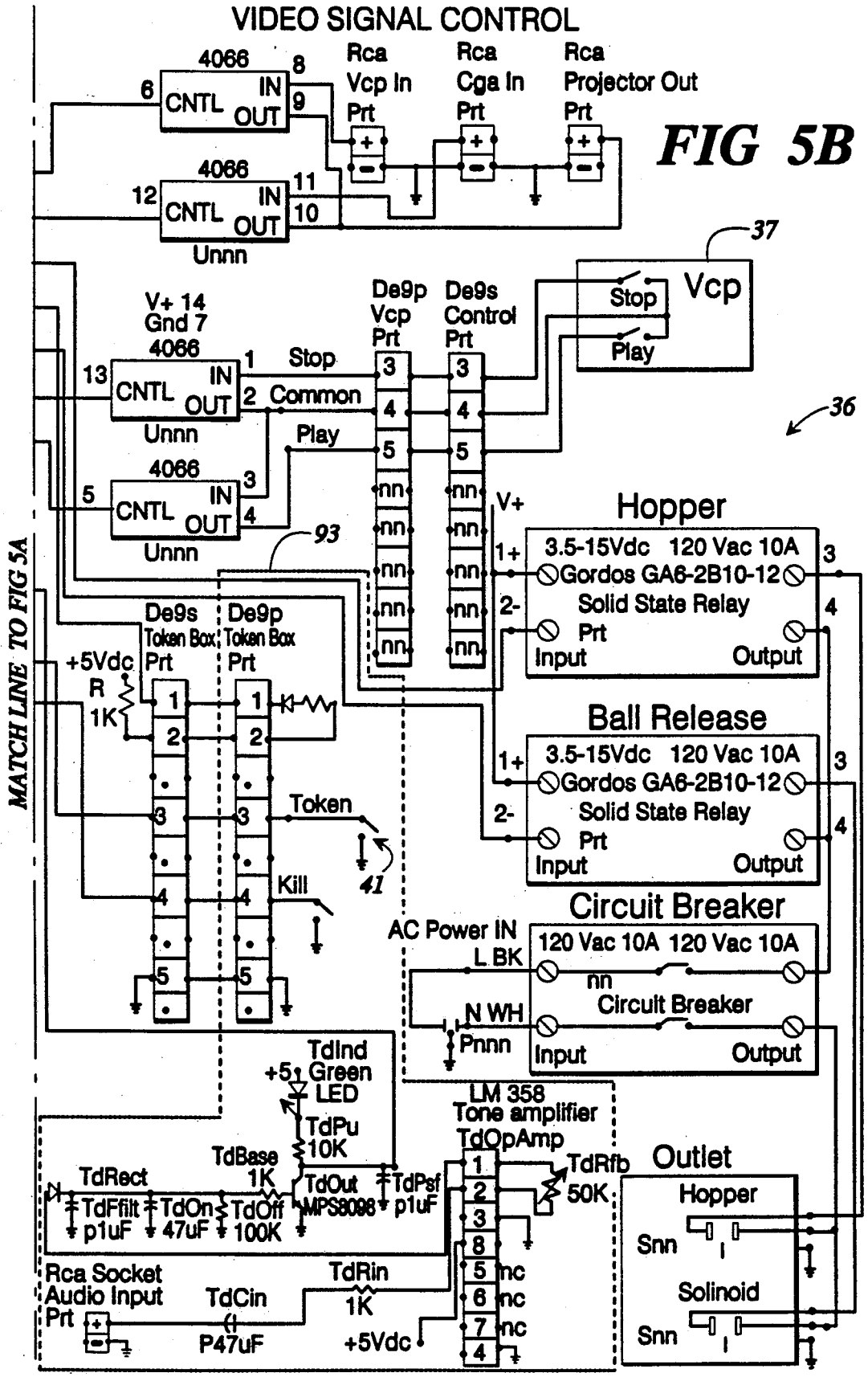
VIDEO SIGNAL CONTROL
4066
CNTL
IN
OUT
Unnn
Rca Vcp In Prt
Rca Cga In Prt
Rca Projector Out Prt
FIG 5B
37
Vcp
Stop
Play
V+ 14
Gnd 7
De9p Vcp Prt
De9s Control Prt
Stop
Common
Play
36
93
Hopper
3.5-15Vdc 120 Vac 10A
Gordos GA6-2B10-12
Solid State Relay
Prt
Input
Output
Ball Release
Circuit Breaker
120 Vac 10A 120 Vac 10A
Circuit Breaker
AC Power IN
L BK
N WH
Pnnn
MATCH LINE TO FIG 5A
De9s Token Box Prt
De9p Token Box Prt
+5Vdc
R 1K
Token
Kill
41
TdInd Green LED
TdPu 10K
TdBase 1K
TdOut MPS8098
TdPsf p1uF
TdRect
TdFilt p1uF
TdOn 47uF
TdOff 100K
LM 358 Tone amplifier TdOpAmp
TdRfb 50K
Outlet
Hopper
Snn
Solinoid
Rca Socket Audio Input Prt
TdCin P47uF
TdRin 1K
+5Vdc

BASEBALL BATTING PRACTICE APPARATUS WITH CONTROL MEANS

TECHNICAL FIELD

This invention relates generally to sports training, and particularly to apparatus for use in practicing baseball batting.

BACKGROUND OF THE INVENTION

Successfully batting a baseball pitched by a talented pitcher is regarded by many as among the most difficult feats of hand to eye coordination in sports. In fact, a success rate of 30% (a 0.300 batting average) is regarded as exemplary and a 25% success rate is typically regarded as the norm. These seemingly low success rates are attributable to, among other things, the speed with which a fast ball gets to home plate, the non-linear path taken by a curve ball and other pitches, and the individual pitcher's ability to conceal both the type of pitch thrown and the ball release. Furthermore, pitchers typically vary the type of pitch thrown and the location (high or low, inside or outside) of the pitch in an attempt to make the pitches more difficult to hit.

Various methods and machines have been used in efforts to improve the batting averages. For instance, it has been common to use a coach or other player to pitch balls to batters for practice. As an alternative to using players and coaches to pitch balls for practice, pitching machines have been developed and employed. One type of pitching machine that has been used has a rotating pitching arm which slings a baseball toward home plate.

Another known type of known pitching machine has a pair of counter-rotating, resilient wheels into which a baseball is introduced. The resilient, rapidly spinning wheels grip the baseball and propel it at a high rate of speed. Typically, the balls are fed manually, one at a time, to the wheels or are fed by a hopper which delivers one ball at a time at regular spaced intervals.

While pitching machines of the types just described provide certain advantages over the use of baseball players and coaches, they provide only limited help in training for batting balls thrown by actual pitchers. It has heretofore been thought that such machines are inherently too mechanical and rote to provide good simulation of actual playing conditions beyond that of propelling balls along established trajectories. Also, these known machines do not afford the batter an opportunity to study the pitcher's motion.

Accordingly, it is seen that a need remains for an apparatus which more closely simulates the conditions faced by batters when batting against live pitchers and which is useful for studying the pitching motion of the pitcher. It is to the provision of such an apparatus, therefore, that the present invention is primarily directed.

SUMMARY OF THE INVENTION

In a preferred form, the present invention comprises a baseball batting practice apparatus including a display screen having a passageway formed therethrough and a video display means for displaying a moving image of a baseball pitcher on the screen adjacent to the passageway. Electronic means are provided for detecting that the baseball pitcher of the moving image is about to release a baseball in the moving image for creating a signal. Baseball propelling means are positioned to one side of the display screen adjacent the passageway for propelling baseballs through the passageway along a forward direction, with the baseball propelling means comprising a pair of counter-rotating wheels defining a nip therebetween.

A baseball staging means is positioned adjacent the baseball propelling means for holding a baseball in a queued position a selected distance above and away from the nip, the baseball staging means comprising a conduit extending between the queued position and the nip. A baseball retaining and releasing means is positioned adjacent the conduit and is operable for retaining the baseball in the queued position and for releasing the baseball from the queued position for allowing the baseball to travel, urged by gravity, along the conduit from the queued position to the nip. Electronic control means are provided, responsive to the signal, for controlling the release of the baseball from the baseball retaining and releasing means to synchronize the propelling of the baseball through the passageway with the moving image on the screen such that the propelled baseball appears to be thrown by the moving image of the baseball pitcher on the screen.

Preferably, the electronic control means includes a computer with programming to allow the owner/operator of the apparatus to monitor operation of the apparatus and to make adjustments in the synchronization of the moving image with the propelling of the baseballs. The computer provides overall control of the apparatus and has the advantage of being adaptable for use with different types of video display means (i.e., video disc players, video cassette players, etc.).

Preferably, a hopper is provided for storing collected baseballs and a means is provided for monitoring the presence of a baseball in the queue. The electronic control means are adapted for ensuring that a baseball is delivered from the hopper to the queue only when needed to maintain a queue of only one baseball, thereby providing greater safety from the unexpected propelling of a second ball.

Also preferably, the retaining and releasing means comprises means for preventing a second baseball, if present adjacent the queued position, from being released along with the first baseball. This also provides enhanced safety from a baseball being unexpectedly propelled.

With this construction, close synchronization can be obtained between the moving image and the actual propelling of the baseballs. This is so because the baseball held in the queued position is maintained a selected distance above and away from the nip. As the baseball is released from the baseball retaining and releasing means, the baseball falls by gravity and travels along a path of known length. Since the only force acting on the baseball is that of the earth's gravity, and since the baseball is traveling along a path of a known length, the time it takes for the baseball to travel from the queued position to the nip can be precisely quantified and is highly repeatable. This allows for a simple and reliable synchronization with the video image.

Accordingly, it is an object of the present invention to provide a baseball batting practice apparatus which closely simulates live conditions to allow the batter to study the pitching motion of a particular pitcher.

It is another object of the present invention to provide a baseball batting practice apparatus which is efficient in operation, durable in construction, and economical in manufacture.

It is a further object of the present invention to provide a baseball batting practice apparatus which is safe in operation.

Other objects, features, and advantages of the invention will become apparent upon reading the following specification in conjunction with the accompanying drawings.

BRIEF DESCRIPTION OF THE DRAWINGS

FIGS. 5A and 5B are an electrical schematic of the baseball batting practice apparatus of FIG. 1.

DETAILED DESCRIPTION

Figure 1:
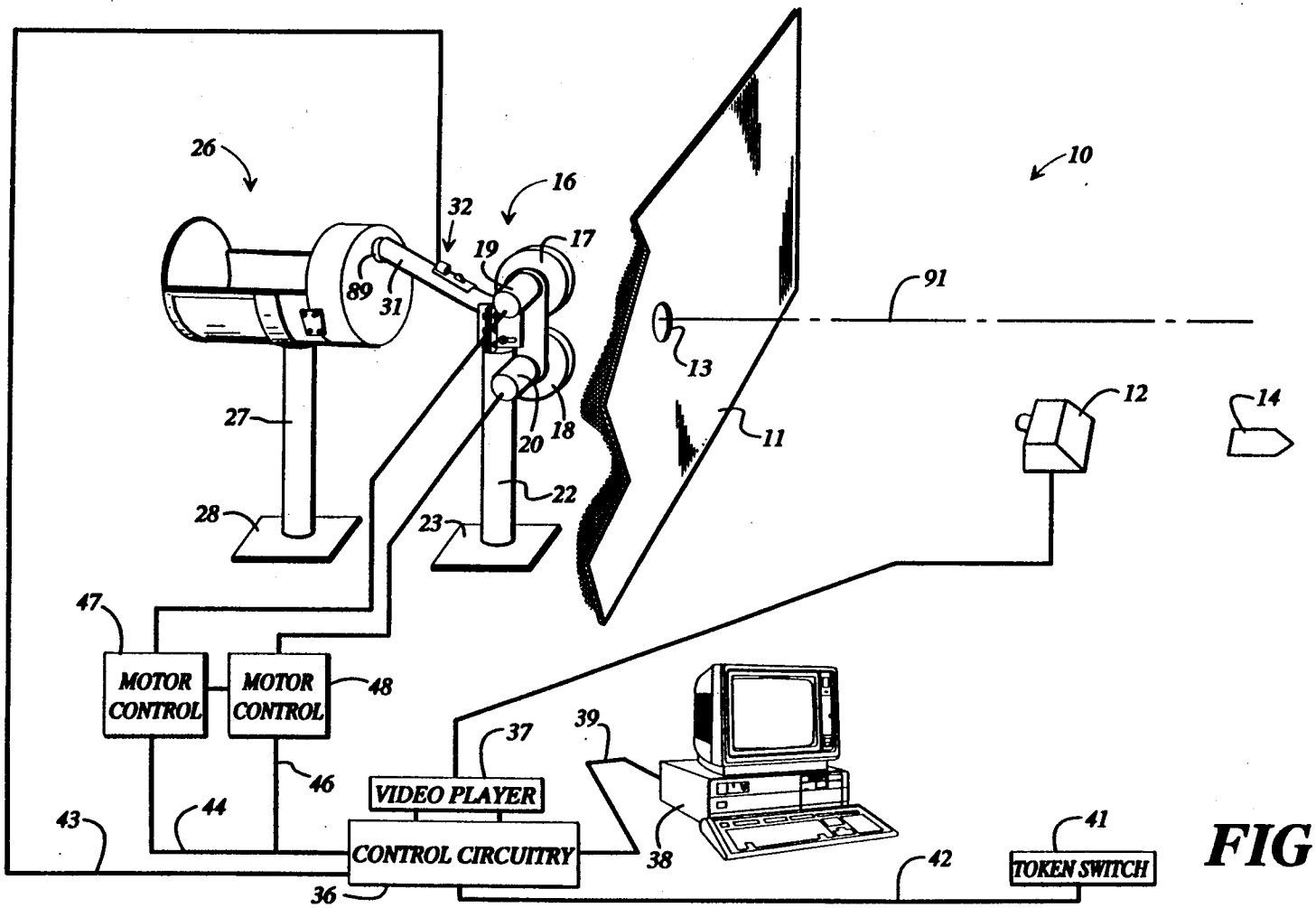
FIG. 1 is a schematic illustration of a baseball batting practice apparatus according to a preferred form of the present invention.

Referring now in detail to the drawing figures, wherein like reference numerals represent like parts throughout the several views, FIG. 1 shows a baseball batting practice apparatus 10 according to a preferred form of the present invention. The apparatus includes a large rectangular projection screen 11 and a video projector 12 positioned to project moving images onto the screen 11. The projection screen preferably is made from a tough, flexible material, such as that used for conveyor belts, and is large enough to allow life-size images of baseball pitchers to be shown thereon. It has two passageways, such as passageway 13, formed therethrough which are large enough to allow baseballs to pass through the screen easily. One of the passageways is for use with images of left-hand pitchers and the other is for use with images of right-hand pitchers. Of course, the passageway not currently in use should be covered with a patch.

The projection screen 11 is positioned an appropriate distance from a home plate 14. A pitching machine 16 is positioned behind the projection screen 11 and includes a pair of counter-rotating, resilient friction wheels 17 and 18 defining a nip therebetween and located adjacent the passageway 13. The wheels are driven by motors 19 and 20 and are supported upon a support post 22, which in turn is supported upon a support base 23.

A collection hopper 26 is positioned behind the pitching machine 16 and is supported upon a support post 27, which in turn is supported upon a support base 28. The hopper 26 is a unit manufactured by Pacer Manufacturing Company of Chattanooga, Tenn., U.S.A., and is of the type normally used to deliver baseballs one at a time at spaced intervals to the pitching machine 16. However, as will be described in more detail below, the apparatus 10 according to the present invention controls operation of the hopper 26 so as to provide a baseball only on an as-needed basis, rather than continuously delivering baseballs at spaced time intervals.

A ramp 31 extends between the forward face of the hopper 26 and a baseball chute portion of the pitching machine 16. A baseball retaining and releasing mechanism 32 is mounted to the ramp 31 for retaining a baseball in a queued position and for releasing the baseball from the queued position for allowing the baseball to travel, aided by gravity, down the ramp and into the baseball chute to introduce the baseball into the nip between the resilient pitching wheels 17 and 18.

A video control unit 36 controls a video player 37 and is connected to a personal computer 38 via a parallel cable 39 for receiving instructions from the personal computer. In the case of a retail apparatus, where users of the apparatus would buy tokens for operating the machine, a token switch 41 associated with an unshown coin box is electrically coupled with the control unit 36 by a cable 42. The control circuit unit 36 also controls operation of the retaining and releasing mechanism 32 by electrical cable 43. Optionally, the control unit 36 can directly control the operation of the motors 19 and 20 using electrical cables 44 and 46 and motor control networks 47 and 48.

Figure 2A:
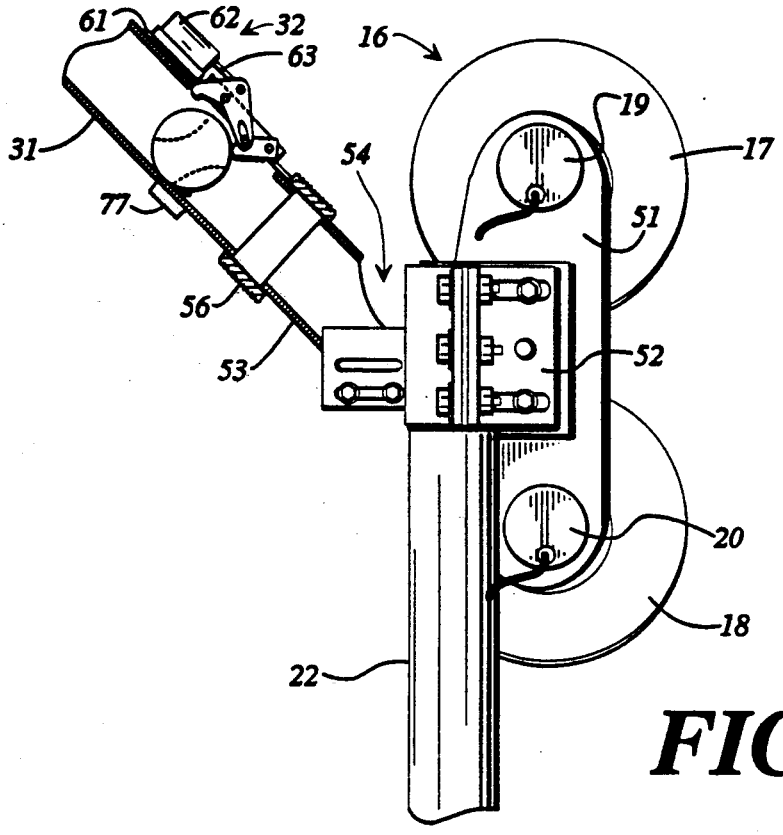
FIGS. 2A and 2B are side elevation views, partially cut away, of a portion of the baseball batting practice apparatus of FIG. 1.
Figure 2B:
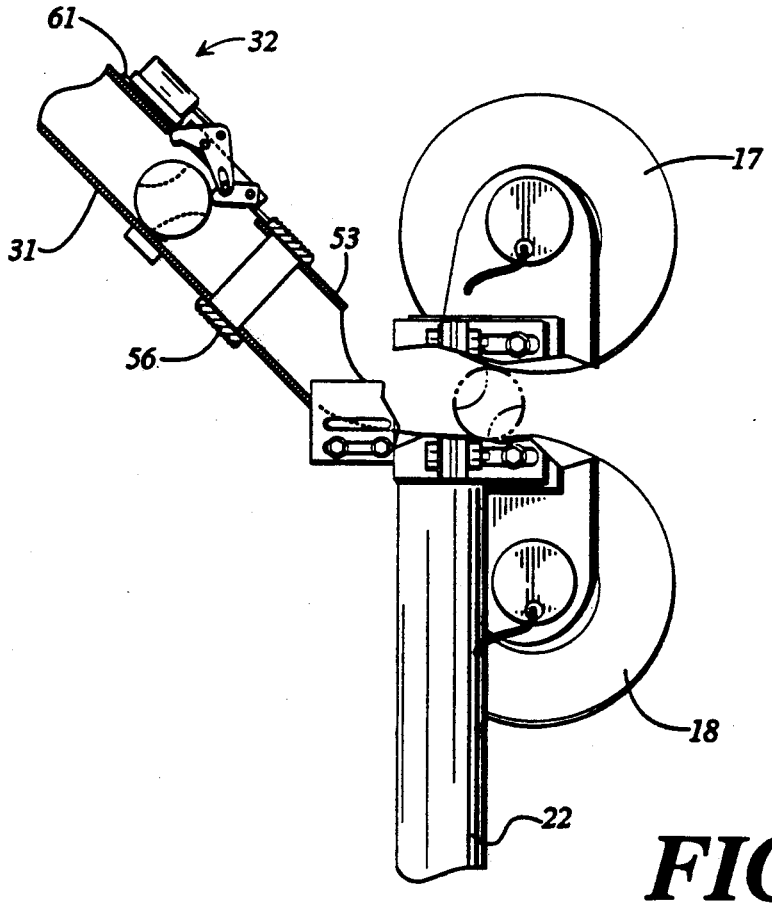

Referring now more specifically to FIGS. 2A and 2B, it can be seen that the motors 19 and 20, and the resilient pitching wheels 17 and 18, are mounted to a yoke 51, which is adjustably mounted to a support plate 52 by bolts, in a known manner. The conventional pitching machine 16 is manufactured by Pacer Manufacturing Company of Chattanooga, Tenn. A baseball introduction chute 53 is generally curved and includes a partially cut-away top portion indicated at 54, and is adapted to introduce a baseball into the nip between the resilient wheels 17 and 18. This is shown somewhat schematically in FIG. 2B in which a baseball is shown in phantom lines in the nip between the pitching wheels 17 and 18.

A short flexible tubing member 56 extends between the baseball chute 53 and the ramp 31 and tends to prevent vibrations or mechanical shocks from being transmitted from the baseball chute 53 to the ramp 31.

Figure 3A:
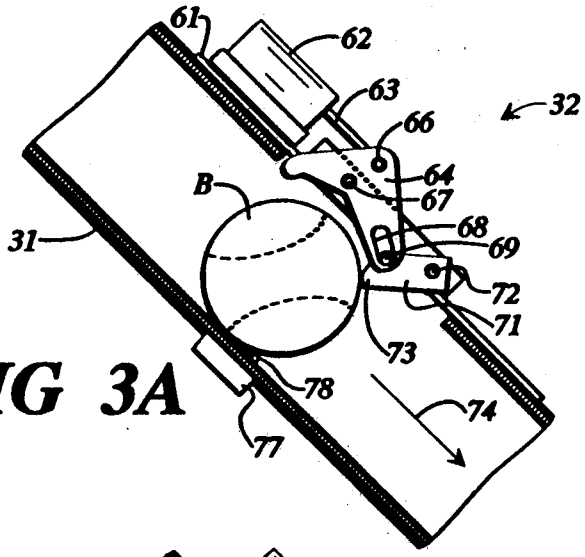
FIGS. 3A and 3B are schematic, sectional views of a ball release portion of the baseball batting practice apparatus of FIG. 1.

The baseball retaining and releasing mechanism 32 is mounted to a mounting plate 61 which in turn is mounted to the ramp 31. The baseball retaining and releasing mechanism 32 includes a solenoid 62 mounted to the mounting plate 61. A piston rod 63 of the solenoid 62 is pivotally connected at its distal end to a pivot plate 64 with a pin 66. The pivot plate 64 is generally boomerang-shaped and is pivotally mounted about a pivot pin 67 relative to the mounting plate 61. One end of the pivot plate 64 has an elongated slot 68 formed therein for slidably receiving a pin 69 extending through the slot and into a baseball retaining toe plate 71. The toe plate is pivoted at one end thereof about a pin 72 relative to the mounting plate 61. A distal end of the toe plate 71 has a generally rounded toe for contacting a baseball B for preventing the baseball from traveling down the ramp 31 in the direction of direction arrow 74 when the retaining and releasing mechanism 32 is in the position shown in FIG. 3A.

Figure 3B:
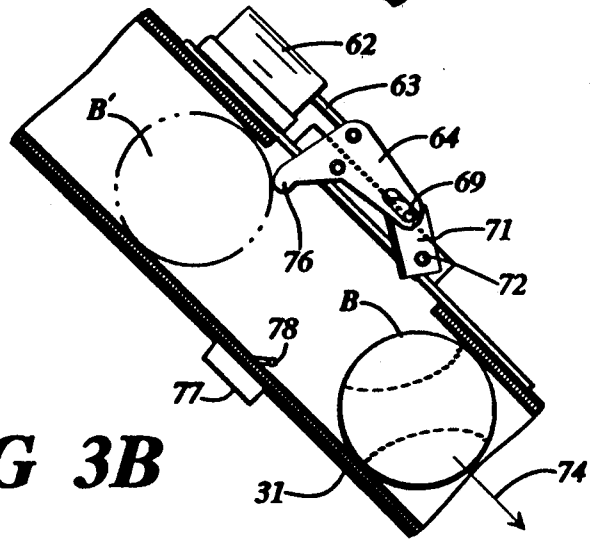

When the pivot plate is rotated to the position shown in FIG. 3B by retraction of the piston rod 63 of the solenoid 62, the toe 73 of the toe plate 71 is rotated upwardly out of the way of the baseball B, allowing the baseball to travel down the ramp 31 in the direction of direction arrow 74 toward the flexible tubing 56 and the chute 53 (see FIG. 2B). With the pivot plate 64 in the position shown in FIG. 3B, a foot portion 76 of the pivot plate extends into the ramp for preventing a subsequent baseball B', if present, from traveling unexpectedly down the ramp 31 in the direction of direction arrow 74. This decreases the risk that a baseball will suddenly and unexpectedly be propelled from the pitching machine when the batter is unprepared. A microswitch 77 having a contact 78 is positioned for detecting the presence of a baseball B at the baseball retaining and releasing mechanism 32.

Figure 4:
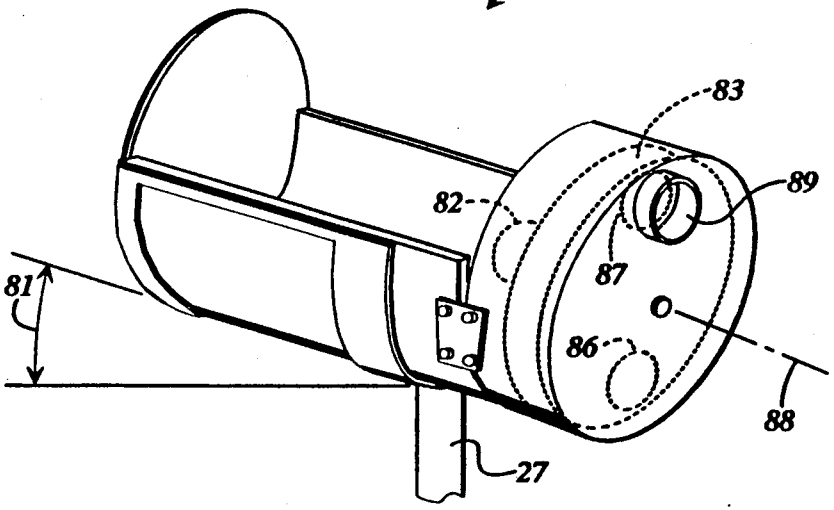
FIG. 4 is a perspective illustration of a ball hopper portion of the baseball batting practice apparatus of FIG. 1.

As shown in FIG. 4, the hopper 26 includes a generally half-cylindrical drum with an open side facing up for receiving collected baseballs. The drum is canted at an angle 81 so that baseballs run downwardly to allow them to be dispensed one at a time. An outlet 82 is sized to allow a baseball to pass therethrough and out the end of the drum. A plate valve 83 is positioned beside the outlet 82 for receiving a baseball therefrom into one of two holding chambers 86 and 87. As the plate valve rotates about axis 88, a baseball held within the holding chamber is transported from the outlet 82 toward a discharge port 89. The discharge port connects to an upper end of the ramp 31 (unshown in FIG. 4).

At this junction between the discharge port 89 and the ramp 31, an optional shutter valve (unshown) can be mounted and electrically operated by the control unit 36 for preventing the discharge of a baseball from the discharge port 89 except when needed and desired. This can provide an additional safety factor to prevent the unexpected introduction of a baseball into the pitching wheels 17 and 18 or can be used instead of the mechanism 32.

The personal computer 38, linked with the electronic control unit 36, provides a suitable user interface to allow the owner/operator of the apparatus to monitor operation of the apparatus and to make any needed adjustments in the synchronization of the moving image with the propelling of the baseballs. The computer provides overall control of the apparatus and has the advantage of being adaptable for use with different types of video display means (i.e., video disc players, video cassette players, etc.)

Figure 5A:
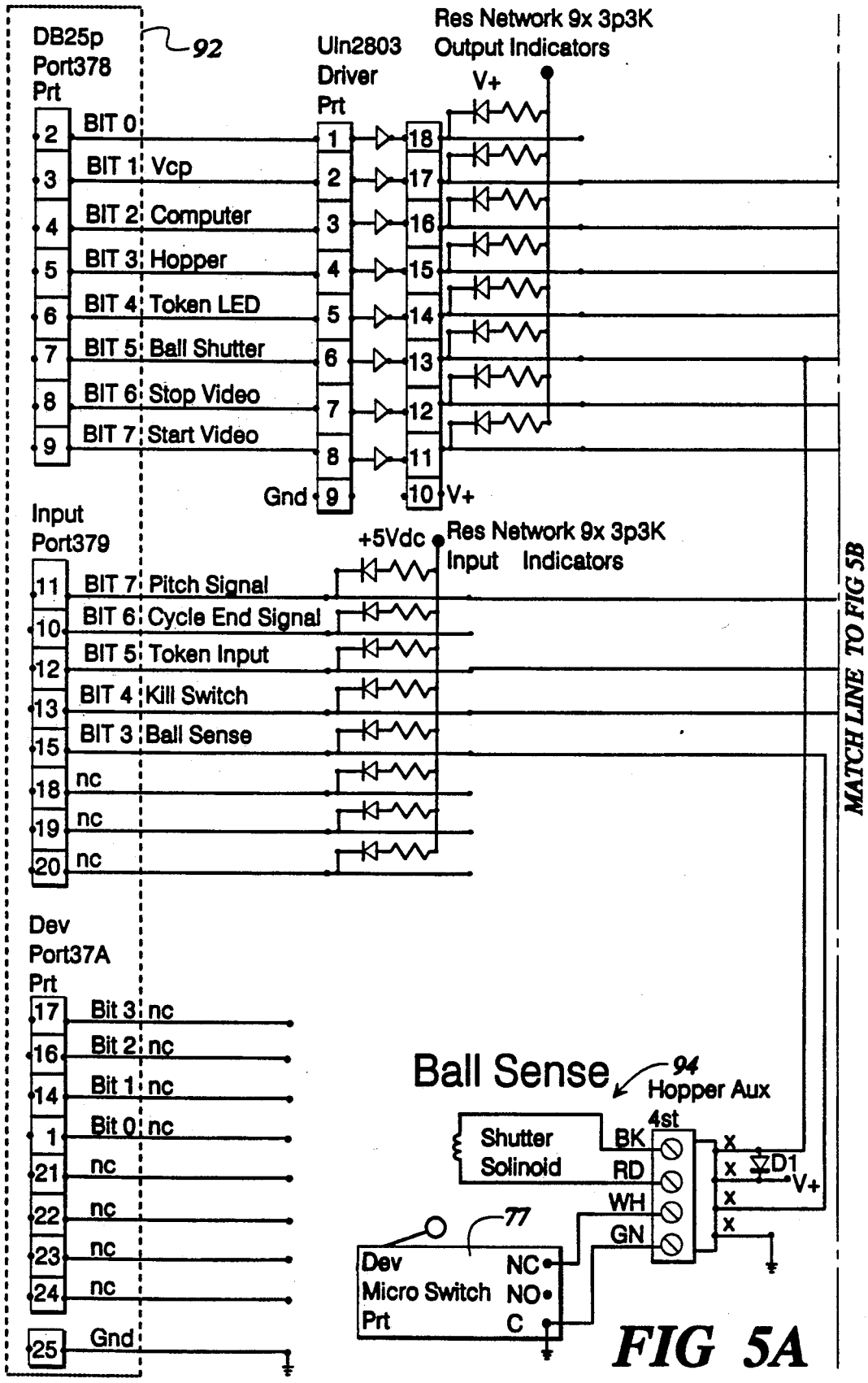
Figure 6:
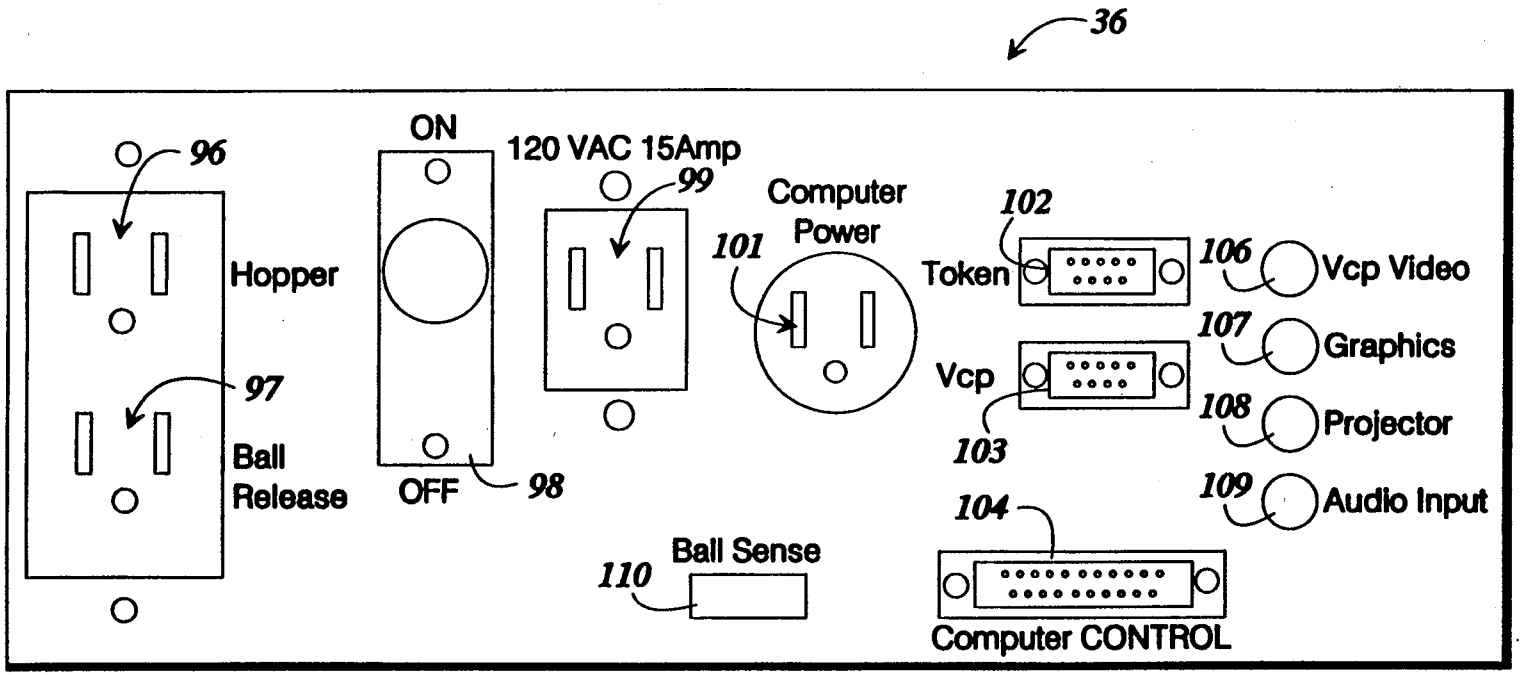
FIG. 6 is a schematic front elevation of a portion of the baseball batting practice apparatus of FIG. 1.
Figure 7A:
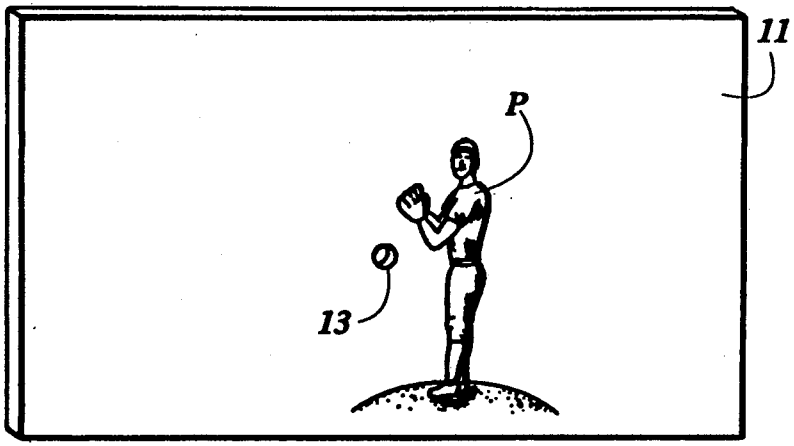
FIGS. 7A-7D are perspective views of a portion of the baseball batting practice apparatus of FIG. 1, with images of a baseball pitcher shown thereon during a windup and delivery sequence.
Figure 7B:
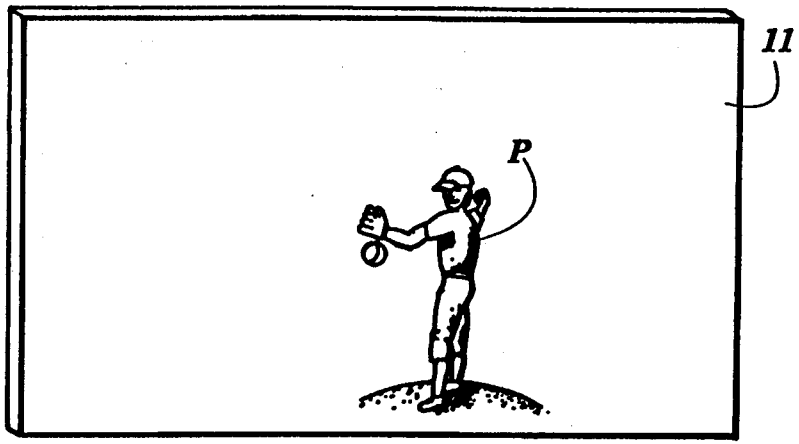
Figure 7C:
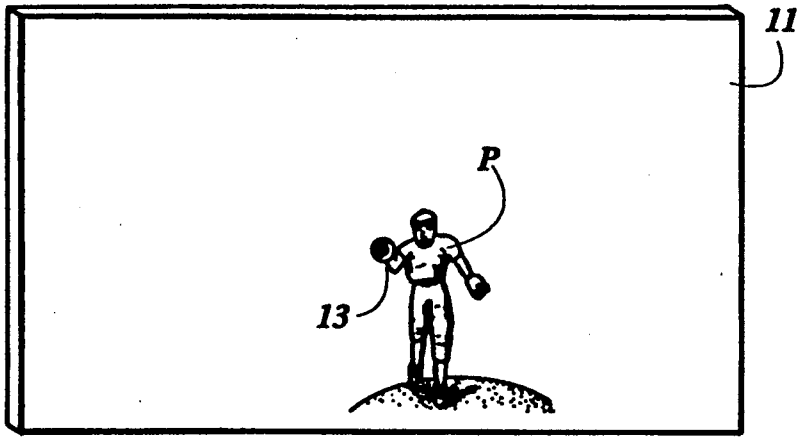
Figure 7D:
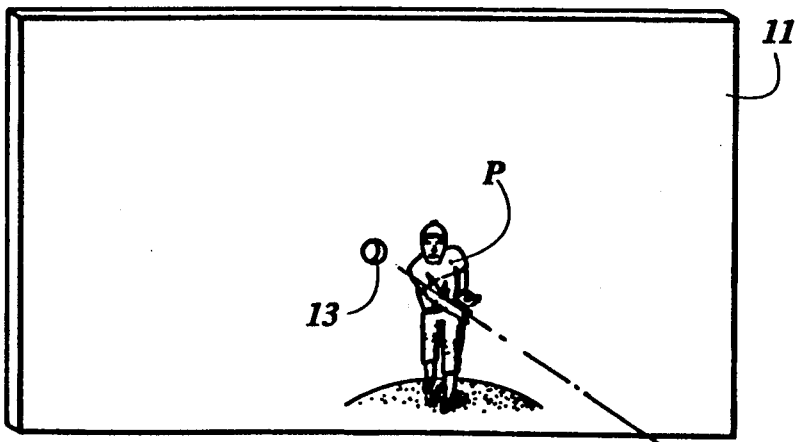

Referring now to FIGS. 5A, 5B and 6, the electronic control unit 36 is considered in more detail. FIGS. 5A and 5B show an electrical schematic of the electronic control unit and also shows the electrical connection of the control unit 36 with the microswitch 77, with the parallel port 92 of the personal computer 38, with the token box 93 (including the token switch 41), with the video player 37, and with an optional shutter solenoid 94.

FIG. 6 shows a schematic, front view of the front panel of the electronic control unit 36. As depicted in FIGS. 5A and 5B and 6, the hopper and the ball release solenoid 62 are controlled by providing or not providing power thereto. Thus, as shown in FIG. 6, female 3-way plug outlets 96 and 97 are provided for the hopper and the ball-release, respectively. A 10 amp circuit breaker 98 is provided for turning the control unit 36 on and off. A male 3-way plug 99 is provided for connecting the control unit 36 with a source of 120 volt electrical power. A female 3-way plug 101 is provided for connecting the personal computer 38 with electrical power. RS-232 ports 102 and 103 are provided for communicating with the token box 93 and with the video player 37, respectively. A parallel port 104 provides communication with the personal computer 38 through a suitable parallel cable. RCA jacks 106, 107, 108, and 109 carry signals for the video player video, for graphics, to the projector, and an audio input, respectively. A port 110 provides communication with the microswitch 77.

The personal computer 38 is provided with programming so that the owner/operator can choose from among the following operations:

1. Performing a first-time installation of the software;
2. Running the software;
3. Testing the individual system components; and
4. Setting up a pre-programmed tape library.

When running the software, the computer screen initially displays an instruction to the operator indicating that the operator should rewind the video player and then to hit the STOP button on the video player. Preferably, the video player is of the "autorepeat" type. The system then waits for the insertion of a token. Upon the insertion of a token, an unshown indicator light on the coin box 93 (See FIG. 5A and 5B) is illuminated indicating that the system is running and that no more tokens will be accepted. The software then checks to make sure that a ball is in place in the ramp by checking the signal from the microswitch 77. If not, then the plate valve in the hopper is rotated to deliver a ball from the hopper 26 to the baseball retaining and releasing mechanism 32. With a baseball in place, the video player 37 is turned on directly from the control unit 36 (note that the video player has been slightly modified so that play and stop instructions can be received directly from the control unit 36 as shown in FIGS. 5A and 6B). A selected number of pitches are then shown, one at a time, on the screen using the video player and baseballs are propelled along a forward direction 91 (see FIG. 1) in synchronization therewith in a manner which will be described in more detail below.

Synchronization of the actual propelling of the ball with the video image of the pitcher pitching the ball is accomplished by constantly checking for a signal on the recorded video image indicating that a pitch is about to be made. Typically, this signal should precede the apparent release of the ball by the pitcher in the video image by approximately three seconds. Preferably, a one kilohertz audio tone is embedded on the video tape to indicate the upcoming pitch of a ball. Upon detection of the one kilohertz audio tone, and after a suitable programmed delay, the baseball retaining and release mechanism is triggered to release the baseball therefrom. (Of course, if a baseball is not already present at the baseball retaining and releasing mechanism, the hopper should be previously operated to discharge a ball thereto.) The ball release mechanism is thereby activated which allows the previously loaded ball to roll down the ramp and into the ball chute and to make contact with the pitching wheels. The exact time that the ball is released from the retaining and releasing mechanism to synchronize the propelling of the ball through the passageway 13 with the video image of the pitcher throwing the ball is established by calibration.

An important advantage of the present invention is that the distance the ball has to travel before engaging the resilient pitching wheels is now held constant. This results in repeatable and reliable travel times for the ball, since the ball is only acted upon by gravity and not by other significant forces. This allows precise synchronization of the actual pitched ball with the image of the pitched ball. It also has the advantage of being extremely reliable and simple in construction and operation. Any ball which might undesirably be behind the first ball in the ramp is prevented from being fired as shown in FIG. 3B.

The circuitry used to detect the one kilohertz tone consists of a A/C-coupled op-amp audio band amplifier with an adjustable or preset gain feeding into a rectifer which provides a direct-current level in order to saturate an NPN transitor, thereby providing a TTL logic level active-low with the presence of a tone on the video media in the frequency range of 100 hertz to 10 kilohertz and with a 300 to 2,000 millivolt RMS range. The gain may be increased to accommodate poorly taped signals, but most likely should be set to the 300 millivolt threshold for safety reasons to prevent noise from triggering an active low signal on the output.

The personal computer is a standard, IBM®-compatible computer and is unmodified. A parallel port, such as a printer port, is used to communicate via a parallel cable with the electronic control unit. The personal computer then manages, through the use of the electronic control unit, the overall apparatus. The software used in the personal computer provides substantial flexibility. For example, through the use of the computer, one can modify the number of pitches which are provided per token received without editing the video tape. Otherwise, one might be required to put some sort of a stop signal on the tape to indicate that that is the last pitch to be displayed for the token. Also, minor adjustments in the timing can effected without requiring changes to the video tape. Furthermore, one can select from among a library of pitchers, and upon insertion of an appropriate tape having images of that pitcher thereon into the tape player, the computer can make any necessary minor adjustments in the synchronization to correspond to the pitcher selected.

Another advantage and feature of the invention is that the computer monitors, with the use of the microswitch, whether a ball is present at the baseball retaining and releasing mechanism. Also, the computer knows when a baseball is supposed to be thrown (i.e., 3 seconds after detection of the one kilohertz tone). If a ball remains at the baseball retaining and releasing mechanism after it should have been released, the computer detects a malfunction and shuts down the operation of the apparatus. Also, if the microswitch fails, the system is likewise shutdown. The computer can also be used to identify other system faults.

Another advantage of the use of a standard computer is that the computer can generate graphics, as for advertising and marketing purposes, with commercially available graphics hardware and software. The computer-generated graphics can be displayed between uses of the apparatus by sending the graphics signals to the electronic control unit for relaying to the video projector. The computer thus allows advertising, or other messages to be displayed without editing existing video tapes. Of course, studio time for editing video tapes is expensive and should be avoided if possible. Also, it can be cumbersome and expensive to recall existing video tapes from various installations located at far flung locations for the purposes of changing the video tape to add new information. In this regard, the use of a computer is quite economical. Also, applicants have found that the computer controlled apparatus is economical to manufacture, as compared with other ways of controlling and synchronizing the operation of the apparatus.

As shown in FIG. 7A–7D, the batter sees a pitcher P projected on the screen 11 go through his wind-up and delivery. As the pitcher's hand holding a baseball is shown on the screen 13 moving towards a position in which the baseball is released, (FIG. 7C) the pitcher's hand approaches the passage 13, a ball B is propelled through the passage by pitching machine 16.

It thus is seen that the combination of the pitching machine, baseball retaining and releasing mechanism for holding a baseball in a queued position, the video player and the synchronization control unit provides a simple yet effective means for synchronizing the on-screen images with the delivery of balls from the pitching machine. So constructed and used, the baseball batting practice apparatus can enable baseball batters to practice batting against a particular pitcher and allow the batter to learn that particular pitcher's pitching motion.

As mentioned earlier, there is much that a pitcher can do in the manner of his delivery of the pitch to make the pitch more difficult to hit. For instance, many pitchers attempt to keep the baseball hidden from sight until the last possible moment before ball release. The baseball batting practice apparatus enables the batter to become familiar with the pitcher's release to be better able to time the beginning of his swing relative to the release of the ball. Of course, model and previously unknown pitchers may also be displayed.

While the invention has been disclosed in a preferred form, it will be obvious to those skilled in the art that many modifications, additions, and deletions may be made therein. For example, while a VHS video cassette player is presently contemplated as the video player 37, it is possible to use a laser disk player or other video playback mechanisms. These and other modifications fall within the spirit and scope of the following claims.

We claim:

1. A baseball batting practice apparatus comprising:

a display screen having a passageway therethrough;

video display means for displaying a moving image of a baseball pitcher on said screen adjacent said passageway;

electronic means for detecting that the baseball pitcher of the moving image is about to release a baseball in the moving image for creating a signal;

baseball propelling means positioned to one side of said display screen adjacent said passageway for propelling baseballs through said passageway along a forward direction, said baseball propelling means comprising a pair of counter-rotating wheels defining a nip therebetween;

baseball staging means adjacent said baseball propelling means for holding a baseball in a queued position a selected distance above and away from said nip, said baseball staging means comprising a conduit extending between said queued position and said nip, and baseball retaining and releasing means adjacent said conduit operable for retaining the baseball in said queued position and for releasing the baseball from said queued position for allowing the baseball to travel, urged by gravity, along said conduit from said queued position to said nip; and electronic control means responsive to said signal for controlling the release of the baseball from said baseball retaining and releasing means to synchronize the propelling of the baseball through said passageway with the moving image such that the propelled baseball appears to be thrown by the moving image of the baseball pitcher.

2. A baseball batting practice apparatus as claimed in claim 1 wherein said electronic control means comprises a computer for allowing an operator of the apparatus to monitor operation and to make adjustments in the synchronization of the propelling of the baseball through said passageway with the moving image.

3. A baseball batting practice apparatus as claimed in claim 1 further comprising a baseball hopper and means for detecting the presence of a baseball at the baseball retaining and releasing means and for delivering an additional baseball only when needed to maintain a queue of only one baseball.

4. A baseball batting practice apparatus as claimed in claim 1 wherein said baseball retaining and releasing means comprises means for preventing a second baseball, if present adjacent said queued position, from being released along with the first baseball.

5. A baseball batting practice apparatus as claimed in claim 1 wherein said baseball retaining and releasing means comprises a member pivotally mounted to said conduit for pivotal movement between a retaining position and a releasing position, said member including a first portion, which when said member is in said retaining position, at least partially obstructs said conduit.

6. A baseball batting practice apparatus as claimed in claim 5 wherein said member comprises a second portion, which when said member is in said releasing position, at least partially obstructs said conduit upstream of said queued position.

7. A baseball batting practice apparatus comprising:

a display screen having a passageway therethrough;

video display means for displaying a moving image of a baseball pitcher on said screen adjacent said passageway;

electronic means for detecting that the baseball pitcher of the moving image is about to release a baseball in the moving image for creating a signal;

baseball propelling means positioned to one side of said display screen adjacent said passageway for propelling baseballs through said passageway along a forward direction, said baseball propelling means comprising a pair of counter-rotating wheels defining a nip therebetween;

baseball staging means adjacent said baseball propelling means for holding a baseball in a queued position a selected distance away from said nip and for releasing the baseball from said queued position; and electronic control means responsive to said signal for controlling the release of the baseball from said baseball staging means for synchronizing the propelling of the baseball through said passageway with the moving image on said display screen such that the propelled baseball appears to be thrown by the moving image of the baseball pitcher on the display screen, said electronic control means comprising a computer for allowing an operator of the apparatus to monitor operation thereof and to make adjustments in the synchronization of the propelling of the baseball through said passageway with the moving image.

8. A baseball batting practice apparatus as claimed in claim 7 wherein said baseball staging means comprises means for holding a baseball in a queued position a selected distance above and away from said nip and includes a conduit extending between said queued position and said nip, and said baseball retaining and releasing means adjacent said conduit being operable for retaining the baseball from said queued position for releasing the baseball from said queued position for allowing the baseball to travel, urged by gravity, along said conduit from said queued position to said nip.

9. A baseball batting practice apparatus as claimed in claim 8 wherein said baseball retaining and releasing means comprises means for preventing a second baseball, if present adjacent said queued position, from being released along with the first baseball.

10. A baseball batting practice apparatus as claimed in claim 8 wherein said baseball retaining and releasing means comprises a member pivotally mounted to said conduit for pivotal movement between a retaining position and a releasing position, said member including a first portion, which when said member is in said retaining position, at least partially obstructs said conduit.

* * * * *